US011767624B2

(12) United States Patent
Richter

(10) Patent No.: US 11,767,624 B2
(45) Date of Patent: Sep. 26, 2023

(54) JET SUCTION BOX AND JET SUCTION PROCESS

(71) Applicant: AUTEFA SOLUTIONS GERMANY GMBH, Friedberg (DE)

(72) Inventor: Christian Richter, Augsburg (DE)

(73) Assignee: AUTEFA SOLUTIONS GERMANY GMBH, Friedberg (DE)

( * ) Notice: Subject to any disclaimer, the term of this patent is extended or adjusted under 35 U.S.C. 154(b) by 169 days.

(21) Appl. No.: 17/413,380

(22) PCT Filed: Dec. 9, 2019

(86) PCT No.: PCT/EP2019/084271

§ 371 (c)(1),
(2) Date: Jun. 11, 2021

(87) PCT Pub. No.: WO2020/120412

PCT Pub. Date: Jun. 18, 2020

(65) Prior Publication Data

US 2022/0025563 A1 Jan. 27, 2022

(30) Foreign Application Priority Data

Dec. 14, 2018 (DE) ..... 20 2018 107 163.7

(51) Int. Cl.
*D04H 18/04* (2012.01)
*D06B 15/04* (2006.01)

(52) U.S. Cl.
CPC ..... *D04H 18/04* (2013.01); *D06B 15/043* (2013.01)

(58) Field of Classification Search
CPC ..... D04H 18/04; D04H 18/00; D04H 1/465; D04H 1/492; D04H 3/11; D04H 5/03;
(Continued)

(56) References Cited

U.S. PATENT DOCUMENTS 3,992,746 A * 11/1976 Rhodes ..... D06B 15/043 15/307
4,166,368 A * 9/1979 Beninca' ..... D06B 5/08 34/115

(Continued)

FOREIGN PATENT DOCUMENTS

CN 2542696 Y 4/2003
CN 106222889 A * 12/2016

(Continued)

OTHER PUBLICATIONS

Technologie fur Wasserstrahlverfestigung In: Chemiefasem/ Textilindustrie, 36./88. Jahrgang, Jul./Aug. 1986, S. 594.

*Primary Examiner* — Amy Vanatta
(74) *Attorney, Agent, or Firm* — McGlew and Tuttle, P.C.

(57) ABSTRACT

A jet suction method and a jet suction box (14), for a suctioning apparatus (6) of a device (1) for water jet consolidation of a fibrous material web (2), sucks in the liquid jets (4) emitted by the device (1) for water jet consolidation and issuing from the fibrous material web (2) again. A box casing (18) thereof has arranged therein at least one slot shape casing opening (20) which leads to a box interior (17). The jet suction box (14) has on the box casing (18) at least one nozzle attachment (24) which is arranged above the casing opening (20) and which has a slot shape suction opening (25) with a width steadily increasing towards the box interior (17) and towards the casing opening (20). A width of the casing opening (20) is equal to or greater than the outlet-side width of the suction opening (25).

20 Claims, 8 Drawing Sheets

(58) Field of Classification Search
CPC ..... D06B 15/043; D06B 15/04; D06B 1/02; D06B 5/08; D06B 5/02; D06B 23/042; D21F 1/50; D21F 1/52; D21F 1/523; D21F 1/48; D21F 1/483; B08B 5/046
USPC ..... 28/104, 105, 167; 162/363, 217; 15/309.1, 306.1, 300.1, 302
See application file for complete search history.

(56) References Cited

U.S. PATENT DOCUMENTS

| | | | | |
|---|---|---|---|---|
| 5,718,022 | A | 2/1998 | Vuillaume | |
| 6,412,140 | B1 * | 7/2002 | Fleissner | D04H 18/04 15/309.1 |
| 7,350,279 | B2 * | 4/2008 | Noelle | D04H 18/04 28/104 |
| 2003/0182780 | A1 * | 10/2003 | Fleissner | D04H 18/04 28/104 |
| 2007/0261541 | A1 * | 11/2007 | Munstermann | D06C 23/00 87/14 |
| 2008/0053635 | A1 * | 3/2008 | Berenstain | D04H 18/04 162/217 |
| 2008/0066275 | A1 * | 3/2008 | Munstermann | F16D 1/076 28/104 |
| 2008/0168636 | A1 * | 7/2008 | Munstermann | D04H 18/04 28/104 |
| 2009/0188090 | A1 * | 7/2009 | Munstermann | D04H 18/04 28/104 |
| 2011/0078883 | A1 * | 4/2011 | Muenstermann | D06C 29/00 28/104 |
| 2015/0321459 | A1 * | 11/2015 | Frisch | B32B 37/10 156/497 |
| 2016/0002836 | A1 * | 1/2016 | Seils | D04H 1/498 28/104 |

FOREIGN PATENT DOCUMENTS

| | | | |
|---|---|---|---|
| DE | 28 01 276 | A1 | 7/1978 |
| DE | 37 41 658 | A1 | 6/1989 |
| DE | 10 2004 030 918 | A1 | 7/2005 |
| DE | 102012110741 | A1 | 5/2014 |
| EP | 0853156 | A2 | 7/1998 |
| EP | 1059377 | A1 | 12/2000 |
| JP | 3154851 | B2 | 4/2001 |
| WO | 0179598 | A2 | 10/2001 |
| WO | 2005059217 | A1 | 6/2005 |

* cited by examiner

JET SUCTION BOX AND JET SUCTION PROCESS

CROSS REFERENCE TO RELATED APPLICATIONS

This application is a United States National Phase Application of International Application PCT/EP2019/084271, filed Dec. 9, 2019, and claims the benefit of priority under 35 U.S.C. § 119 of German Application 20 2018 107 163.7, filed Dec. 14, 2018, the entire contents of which are incorporated herein by reference.

TECHNICAL FIELD

The present invention pertains to a jet suction box for a suction device of a fibrous material web, especially of a nonwoven fabric, wherein the jet suction box is intended and configured for suctioning liquid.

TECHNICAL BACKGROUND

A jet suction box of a suction device, which is intended for a hydroentanglement device, with which a fibrous material web is strengthened in the form of a nonwoven fabric with impacting water jets, is known from U.S. Pat. No. 5,718,022 A. The water jets which are emitted by a plurality of injectors of the hydroentanglement device under high pressure are suctioned in with the jet suction box after passing through the material web. The hollow jet suction box has on its box casing a plurality of slot shape casing openings leading to its box interior. The jet suction box is under vacuum, wherein in addition to the casing jets, air from the surrounding area is also suctioned into the hollow box interior through the casing openings.

WO 01/79598 A2 describes a jet suction box of a suction device with a suction nozzle, the suction opening of which has a constant opening width.

SUMMARY

An object of the present invention is to show an improved jet suction technology.

The jet suction technology being claimed, i.e., the jet suction box and the jet suction process, as well as the suction device and the hydroentanglement device equipped therewith have a variety of advantages.

The jet suction technology requires little energy and design effort. It saves resources, is efficient and has a low noise emission. Due to the low design and energy effort, the jet suction technology being claimed is more economical than the state of the art. Finally, even better and more constant strengthening results will be achieved during the strengthening of a fibrous material web with high-pressure liquid jets, especially high-pressure water jets.

The jet suction box being claimed may be an independent component of a suction device and of a hydroentanglement device equipped therewith. The jet suction box may be retrofitted or modified to existing suction devices. It may be implemented as initial equipment in a new suction device as well.

The jet suction box being claimed has on its box casing at least one suction nozzle with a slot shape suction opening, the width of which preferably increases continually towards the box interior. The suction opening may especially have a conically expanding cross section or a stepped expanding cross section. The suction opening opens at the casing opening on the outlet side. The suction opening has an outlet-side opening width, which is greater than the inlet-side opening width.

The pressure loss on the nozzle outlet side may be kept minimal due to the increase in the nozzle width in the jet direction or suction direction. The pressure loss is markedly lower compared to a suction nozzle with constant or narrowed nozzle width. The greater the flow rate is at the nozzle outlet and the greater is the suction rate of the air/liquid mixture from the hollow box interior, the stronger is the impact of the positive effect of the jet suction technology being claimed.

Thanks to the low pressure loss, a moderate vacuum in the box interior and a vacuum generator of small dimensions are sufficient for obtaining a desired vacuum on the inlet side of the suction nozzle and a desired flow rate at the suction nozzle and at a suction opening of the jet suction box. Such a vacuum may be, e.g., 15,000 Pa and a flow rate may be, e.g., 25 m/sec.

The one or more suction nozzles may be arranged at the jet suction box in a suitable manner. They may extend along the suction box axis and, in addition, at right angles to the fibrous material web. The number and arrangement of the suction nozzles may be adapted to the number and arrangement of injectors or nozzle bars of a hydroentanglement device. The suction nozzles may each be located opposite one of these injectors in the emission direction of the emitted liquid jets, especially water jets. The emitted liquid and the ambient air carried along by the jet may be taken up and led away especially well and effectively in the slot and further increased suction opening being claimed. The fibrous material web through which the flow takes place is consequently moistened as little as possible. The following drying effort may be lower for the fibrous material web, as a result of which likewise the consumption of resources is reduced and the efficiency or economic efficiency is increased.

The jet suction box may have on its box casing a plurality of suction nozzles arranged distributed in the circumferential direction. These suction nozzles may be integrated into a correspondingly thick box casing. They may, as an alternative or in addition, be configured as a nozzle attachment and be arranged above a casing opening of the box casing. The nozzle attachment may protrude outwards from the box casing in this case. It may also protrude up to close to a liquid-permeable, especially perforated, conveying device for the fibrous material web. As an alternative or in addition, the nozzle attachment on the box casing may protrude inwards into the box interior.

The configuration having the nozzle attachment has a plurality of advantages. Suction of infiltrated air can be reduced or avoided. Due to one or more nozzle attachments protruding outwards locally from the jet suction box, an intermediate space, which may correspond to the space requirement for the mounting of a drum shape conveying device, may be created between the box casing and the liquid-permeable conveying device. Nozzle attachments protruding from the box casing inwards into the box interior make possible a maximum expansion of the suction box and a maximum inner space volume, which is advantageous for optimizing the suction action and the suction capacity.

The jet suction box being claimed may have any desired, suitable shape. It may also be adapted to said conveying device. In one embodiment, the jet suction box may have a cubic or cuboid shape, whereby the conveying device may be configured, e.g., as a linear section of a conveyor belt.

In the preferred embodiment, the jet suction box is configured as a linear jet suction pipe. This jet suction pipe may have a prismatic casing on the outside with a flat section in the area of the one or more casing openings. The casing may have a cylindrical configuration on the inner side. Due to the flat section, a nozzle attachment may be arranged in an especially effective manner at the jet suction pipe. In a jet suction pipe, the liquid-permeable conveying device may be configured, e.g., as a rotatingly driven conveying drum and be arranged coaxially to the stationary jet suction pipe. The jet suction pipe may also have support surfaces for the conveying drum.

For the mechanical stability of the jet suction box, especially of the jet suction pipe, it is favorable if a plurality of support struts are arranged in the one or more slot shape casing openings. These may be aligned at right angles to one another and be arranged in a lattice-work shape manner. The casing opening adjoins the outlet-side end thereof in case of a nozzle attachment. The width of the casing opening may be equal to or greater than the outlet-side width of the suction opening.

The suction opening may be adjustable in its width. As a result, it may be adapted to different use requirements, especially also to varying modes of operation of the hydroentanglement device. In a plurality of suction nozzles arranged distributed over the transport path of the fibrous material web, the width of their suction openings may be set as equal to one another or different from one another as needed.

For such an adjustment of the width, a configuration of the suction nozzle as a nozzle attachment is especially advantageous. The suction nozzle, especially the nozzle attachment, may have side walls that are movable in relation to each other and an adjusting device for the mutual adjustment thereof. In case of a jet suction pipe, the prismatic outer contour and one or more flat sections are especially advantageous for a suction nozzle adjustment.

The suction device equipped with the jet suction box claimed is especially efficient and economical. The associated vacuum generator may be configured in the above-mentioned manner as a relatively weak unit and thus in a resource- and cost-effective manner. With a recovery unit, the water can be especially advantageously separated from the suctioned water/air mixture and be fed again, as needed, to the hydroentanglement device. The water used during the hydroentanglement process may be utilized effectively and be recovered to a great extent. A discharge of water over the fibrous material web may be kept low.

The hydroentanglement device being claimed may contain a suction device and especially a jet suction box of the type being claimed. The liquid jets emitted under high pressure to the fibrous material web and passing through same may consist of water or any desired, other suitable liquid. Therefore, a hydroentanglement device is defined as one comprising all types of strengthening devices using such high-pressure liquid jets from any desired liquids.

The present invention is shown in examples and schematically in the drawings.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF PREFERRED EMBODIMENTS

Figure 1:
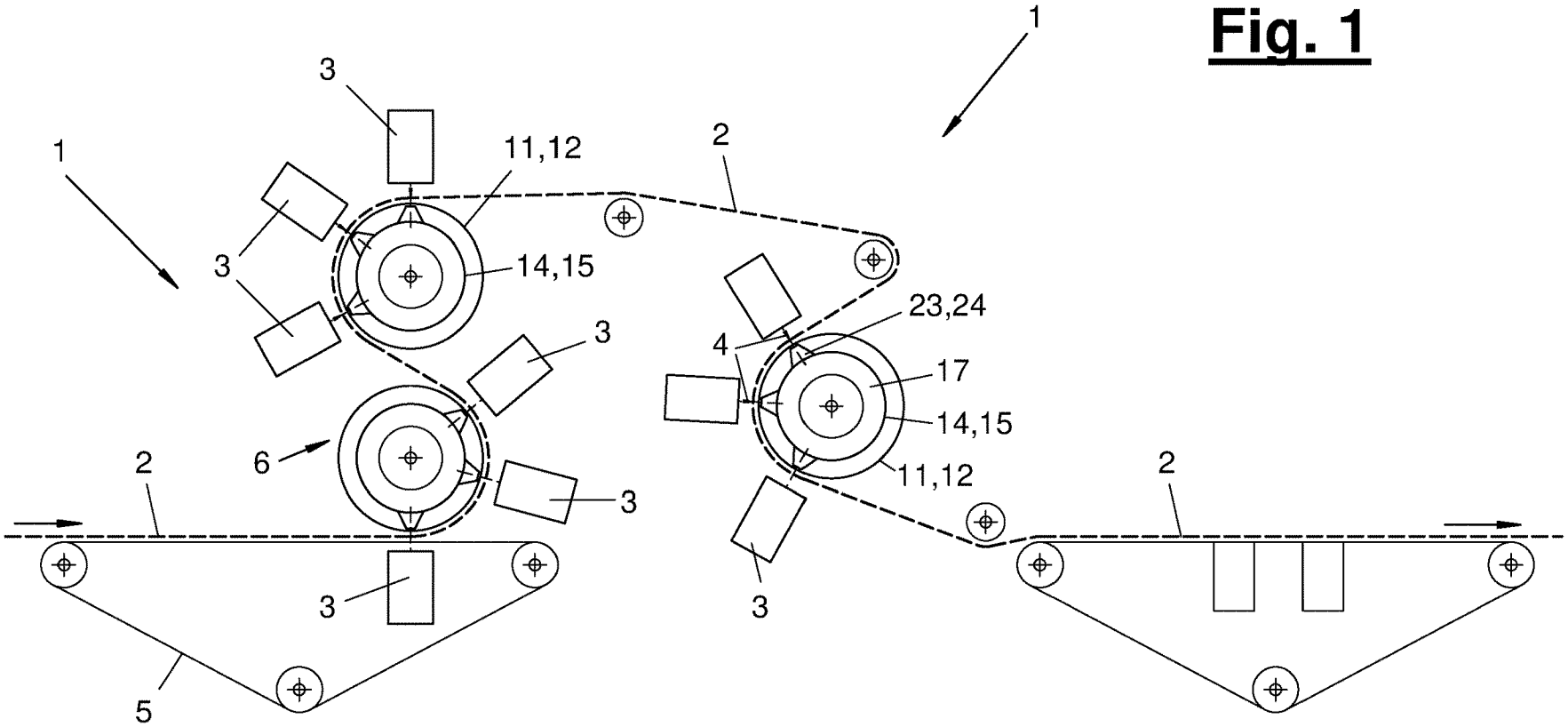
FIG. 1 is a schematic view of a hydroentanglement device with a suction device and with a jet suction box as well as with a fibrous material web.

Referring to the drawings, present invention pertains to a jet suction box (14) and to a process for the jet suctioning of high-pressure liquid jets of a hydroentanglement device (1). The present invention also pertains to a suction device (6) with such a jet suction box (14). Furthermore, the present invention comprises a hydroentanglement device (1) with such a jet suction box (14) and with such a suction device (6). Moreover, the present invention includes a hydroentanglement process and a suction process.

FIG. 1 shows a plant with three hydroentanglement devices (1) for the hydroentanglement of a fibrous material web (2). The fibrous material web (2) consists of textile fibers, especially synthetic fibers. It is configured, e.g., as a nonwoven fabric. It is fed on a transport device (5) from a generating device, not shown, e.g., from a card, to a spunbond tower, to an airlay or the like. In this connection, additional machines, e.g., a nonwoven-layering apparatus, may be interconnected as needed. The transport device (5) may have an endlessly circulating and jet-permeable conveyor belt. The fibrous material web (2) may run through the three hydroentanglement devices (1) one after the other.

The three devices (1) may have a similar configuration to one another. They have each one or more injectors (3). The injectors (3), which are preferably present as a plurality of injectors, are arranged in a distributed manner and one after the other along the conveying path in the conveying direction of the fibrous material web (2).

The fibrous material web (2) is strengthened with thin high-pressure liquid jets (4), especially water jets, which are arranged in series or in a matrix and are emitted from the injectors (3) each against the fibrous material web (2) and pass through same. The respective injector (3) may be configured, e.g., as a nozzle bar, which is aligned at right angles to the fibrous material web (2) and to the transport path thereof and extends for the most part, preferably fully, over the fibrous material web (2) in its breadth.

The emitted liquid jets (4) are taken up, suctioned and transported away with a suction device (6). The suction device (6) has a jet suction box (14) and a conveying device (11) for the transport of the fibrous material web (2) in the area of the injector (3) or of the injectors (3) according to FIGS. 1, 2 and 6. The conveying device (11) supports the fibrous material web (2) against the impacting liquid jets (4).

Figure 6:
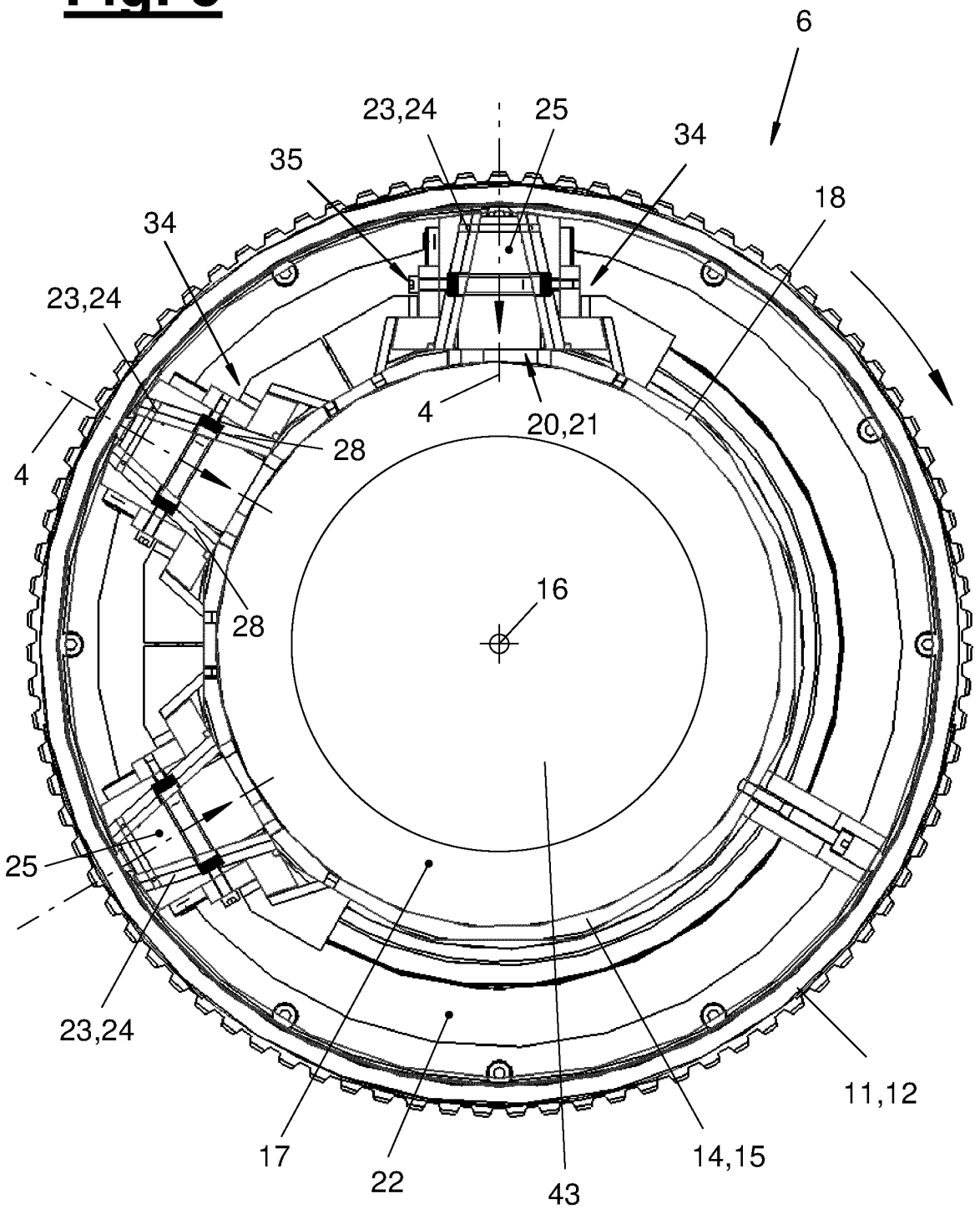
FIG. 6 is a cross sectional view through the jet suction pipe and the conveying drum from FIGS. 1 and 2.

The jet suction box (14) suctions the liquid jets (4) which are being released again from the fibrous material web (2). Moreover, ambient air may be suctioned. The jet suction box (14) is arranged in the direction of emission of the liquid jets (4) below the conveying device (11), which direction of emission is shown in FIGS. 1 and 6. The jet suction box (14) is arranged in a relatively stationary manner against the moving conveying device (11).

In the exemplary embodiments shown, the jet suction box (14) is configured as a long and linear jet suction pipe (15). As an alternative, a different embodiment, e.g., in cuboid box shape, is possible. The features described below regarding the jet suction pipe (15) also correspondingly apply to other types of jet suction boxes (14).

Figure 2:
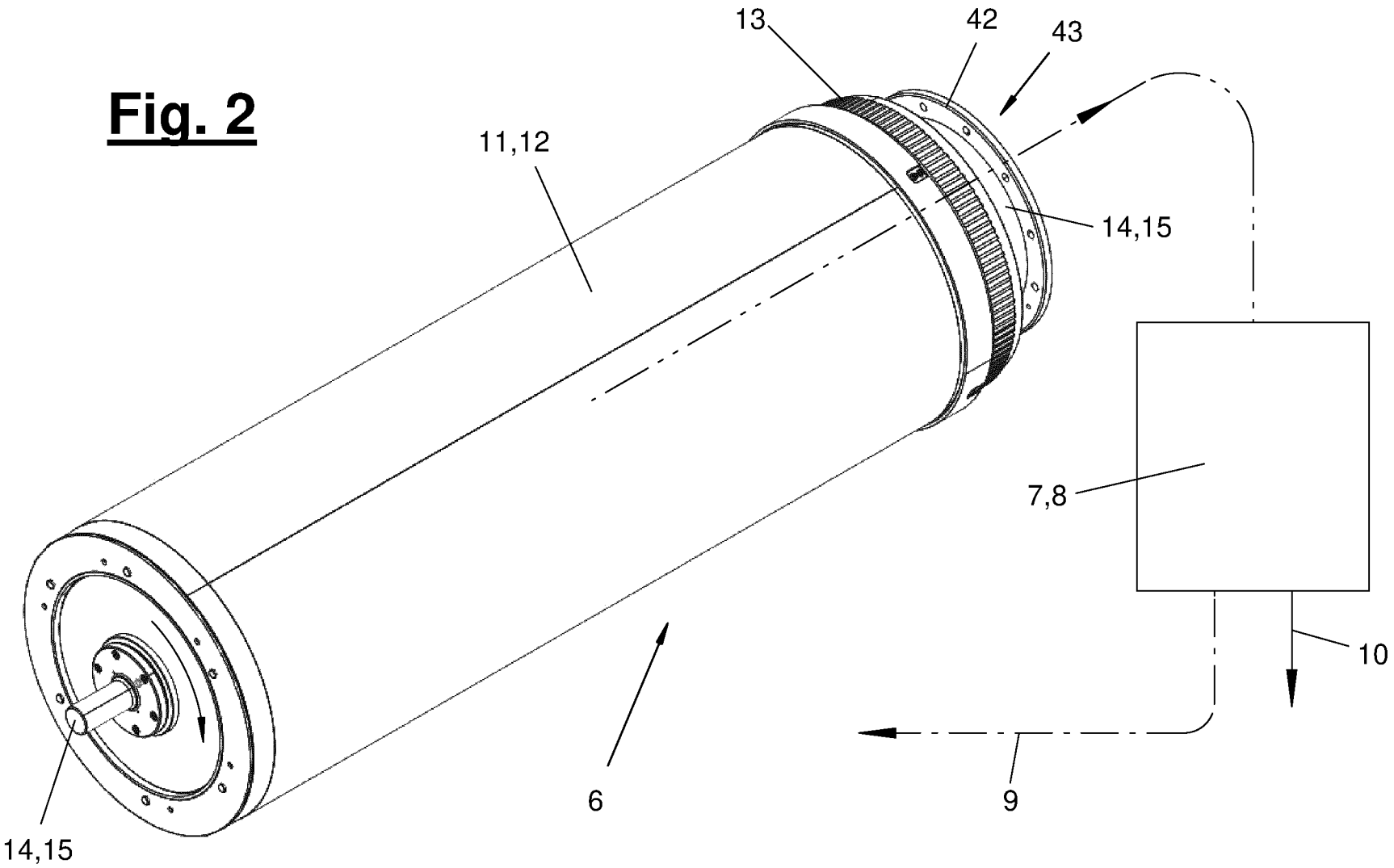
FIG. 2 is a perspective view of an arrangement of a jet suction box configured as a jet suction pipe with an enclosing, rotating conveying drum.

The conveying device (11) is in the exemplary embodiments being shown configured as a rotatingly driven conveying drum (12), in which the jet suction box (14) or jet suction pipe (15) is arranged in a relatively stationary manner. The conveying drum (12) is arranged concentrically to the central axis (16) of the jet suction pipe (15) and rotates about this axis (16). The conveying drum (12) may be driven in a rotating manner in any desired, suitable manner. For this, a drive (13), of which, e.g., a geared ring is shown in FIG. 2, which is arranged at a front end of the conveying drum (12), is provided. The other parts of the drive (13), e.g., a motor with gears and drive pinion, etc., are not shown.

The conveying device (11) has a fluid-permeable configuration. It lets the liquid jets (4) and also air pass through. The conveying device (11) may have for this purpose, e.g., a perforated conveying element. The drum casing is liquid-permeable in the configuration as a conveying drum (12) being shown.

In another variant, not shown, the conveying device (11) may be configured in a different manner, e.g., as a circulating belt conveyor. This may likewise be permeable to liquid and may have, e.g., a perforated conveyor belt.

In the embodiments shown the conveying drum (12) has an especially perforated, cylindrical casing, through the openings of which the liquid jets (4) can reach the jet suction box (14) or jet suction pipe (15). A vacuum, by means of which the emitted liquid jets (4) can be suctioned in an efficient and specific manner into the hollow box interior (17), can be generated in the jet suction pipe (15). The jet suction pipe (15) is closed at one front end and has at the other front end a suction opening (43), through which the suctioned liquid/air mixture can again leave the box interior (17).

The fibrous material web (2) winds around a large part of the circumference of the conveying drum (12). The fibrous material web (2) may be conveyed by the drum rotation and also be transferred to the next conveying drum (12) as well as again be transferred to a conveyor belt or else to a different conveying device after passing through the last hydroentanglement device (1). The fibrous material web (2) may lie directly on the drum casing. As an alternative, a moving conveyor belt may be arranged between them.

An injector (3), whose emitted liquid jets (4) pass through the conveyor belt, is arranged under the transport device (5) and at the location of the transfer of the fibrous material web (2) to the first suction device (6). They liquid jets bring about, in addition, a carrying along and a transfer of the fibrous material web (2) to the first conveying drum (12). FIG. 1 shows this arrangement.

Figure 3:
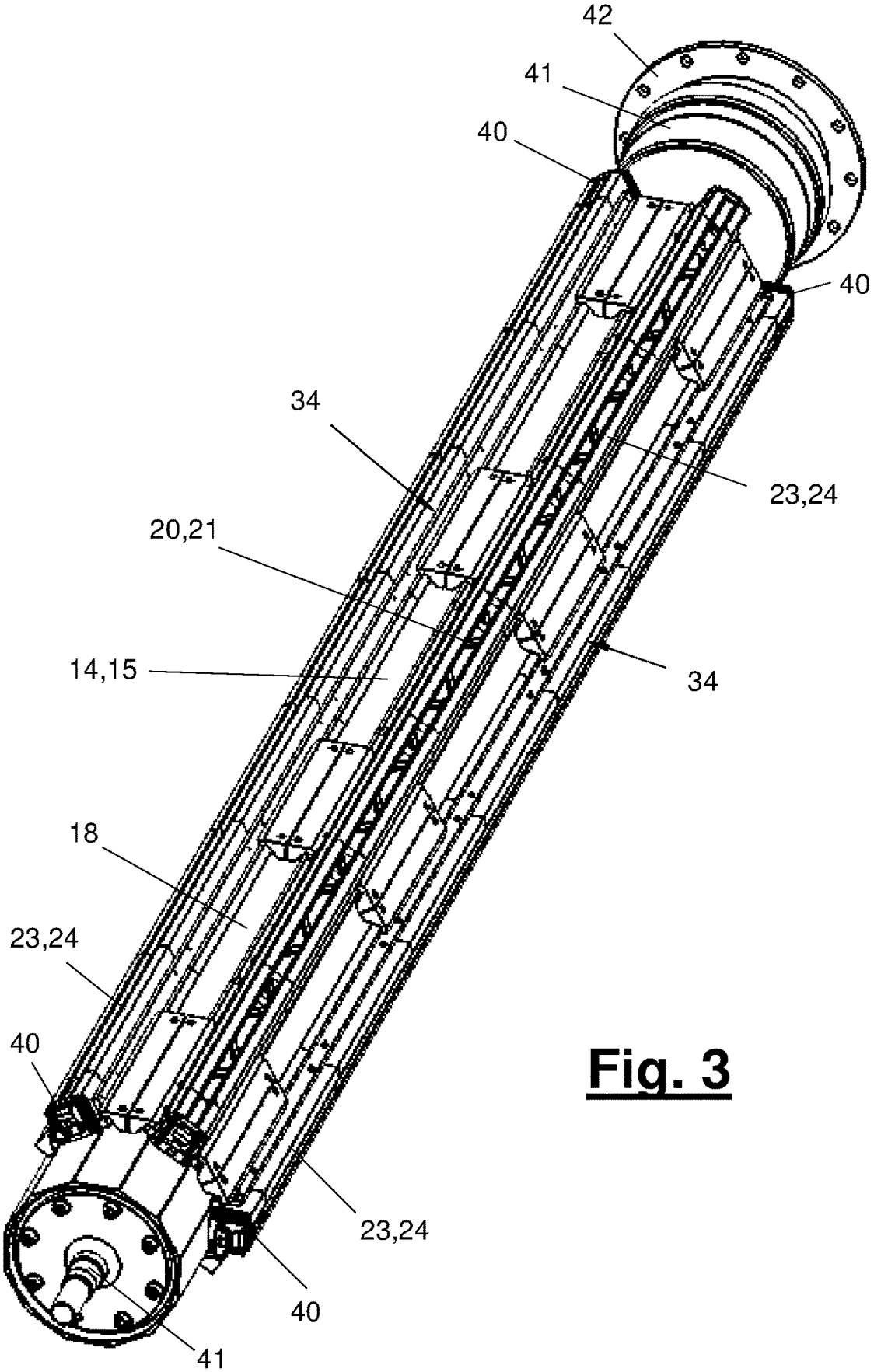
FIG. 3 is a perspective view of the jet suction pipe with three axially aligned suction nozzles according to FIG. 1.
Figure 4:
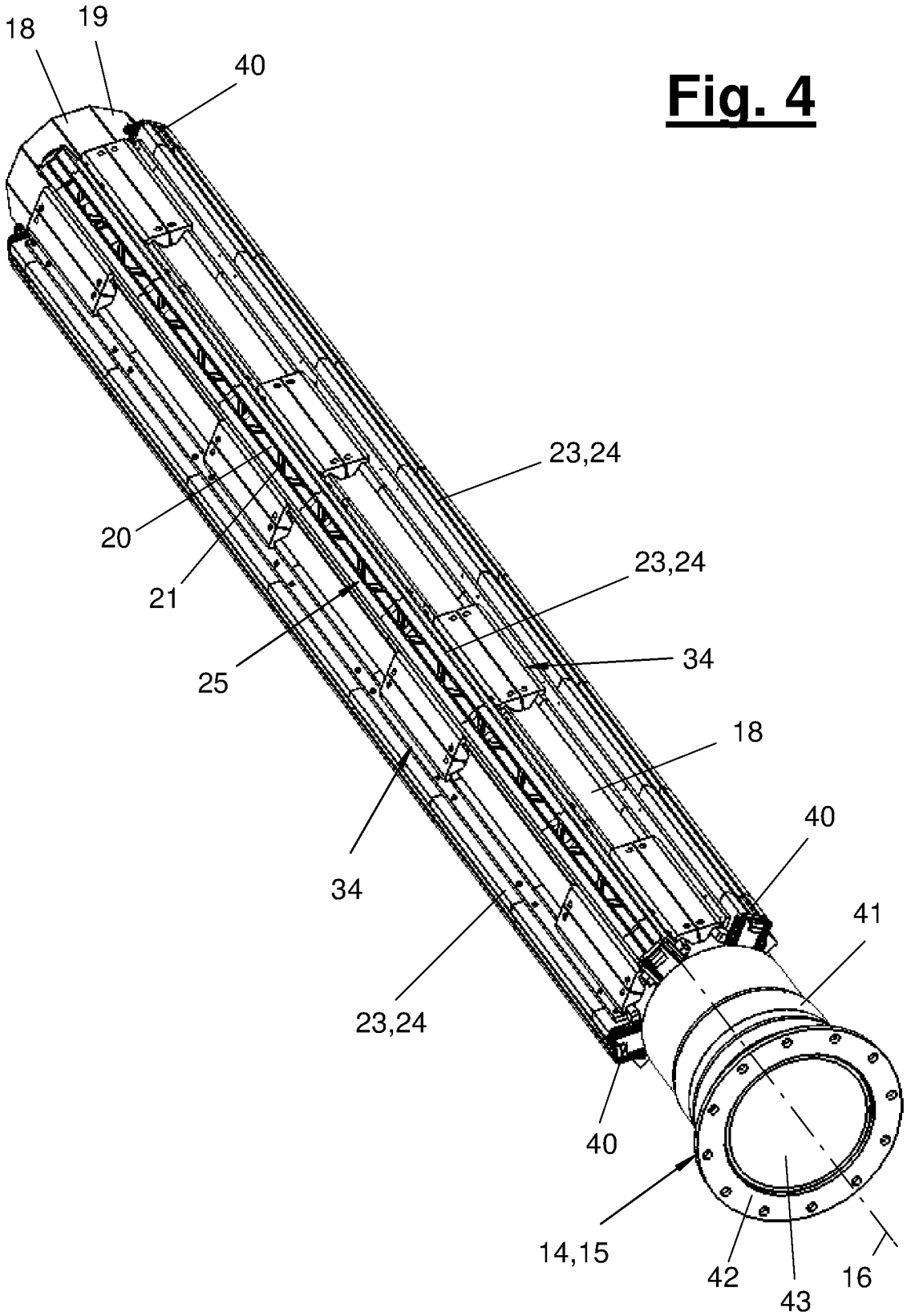
FIG. 4 is a perspective view of the jet suction pipe with three axially aligned suction nozzles according to FIG. 1.
Figure 5:
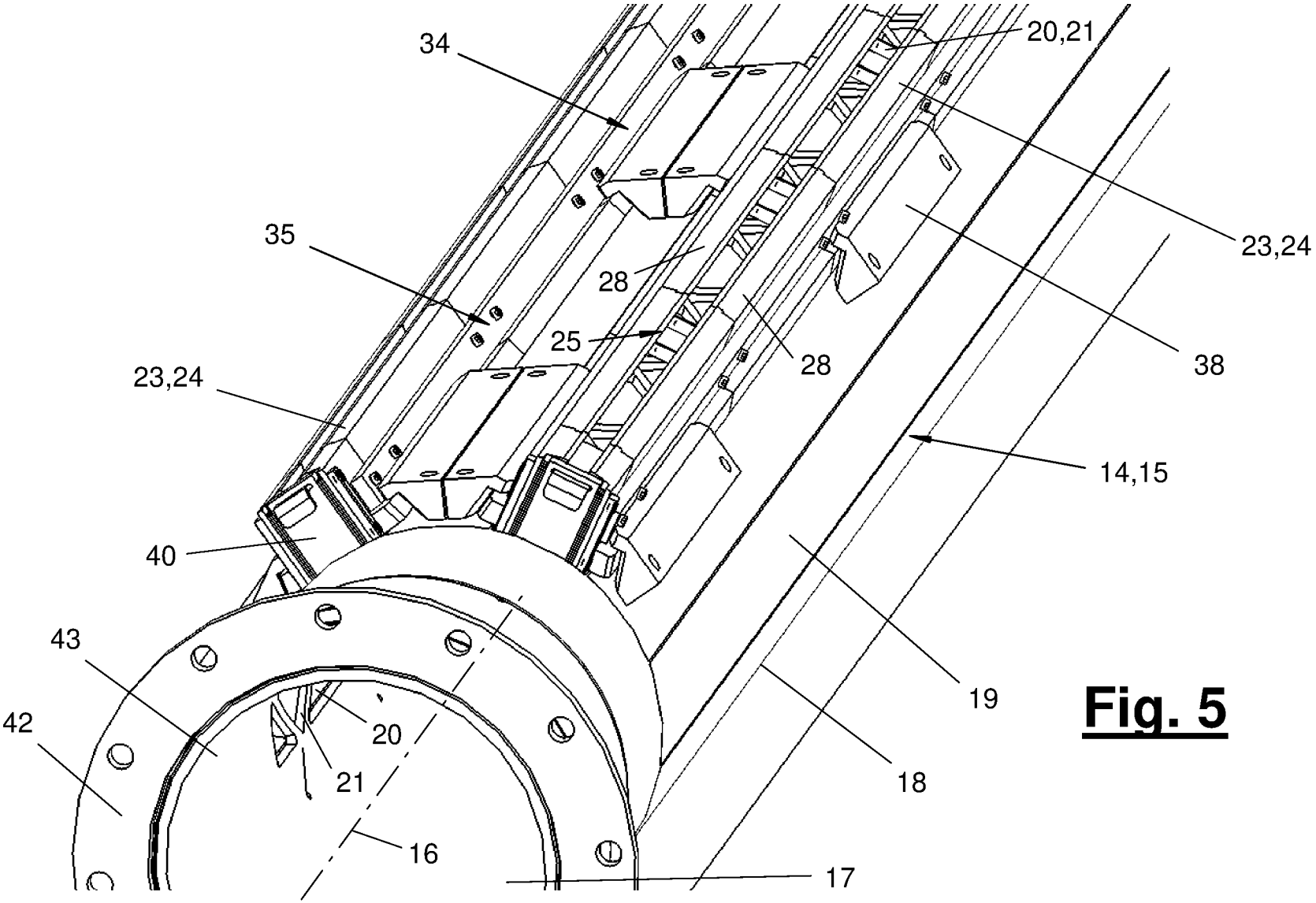
FIG. 5 is a broken-away and enlarged detail view of the front suction pipe area from FIG. 4.

FIGS. 2, 3 and 4 schematically show additional components of the suction device (6). The conveying drum (12) is mounted rotatably on the jet section pipe (15). For this, the jet suction pipe (15) may have at the front-side ends support surfaces (41), which are illustrated in FIGS. 3 and 4. There may be an intermediate space (22), which may correspond to the radial space required for the mounting of the drum, between the jet suction pipe (15) and the conveying drum (12). FIG. 6 shows this arrangement. At the closed front end, the jet suction pipe (15) has a support pin and at the other open front-side end a pipe flange (42) for stationary mounting.

The suction device (6) has a vacuum generator (7), with which the liquid/air mixture is suctioned from the jet suction pipe (15) through the opening (43) and through an adjoining line. Furthermore, the suction device (6) may have a recovery unit (8), with which the liquid is separated from the air and is able to be fed again to the one or more injectors (3) via a return (9) as well as possibly via a purification device. The air may be discharged via an outlet (10). The vacuum generator (7) and the recovery unit (8) are only suggested schematically in FIG. 2. They may be configured and be arranged in any suitable manner. The recovery unit (8) may be configured, e.g., as a cyclone.

Figure 7:
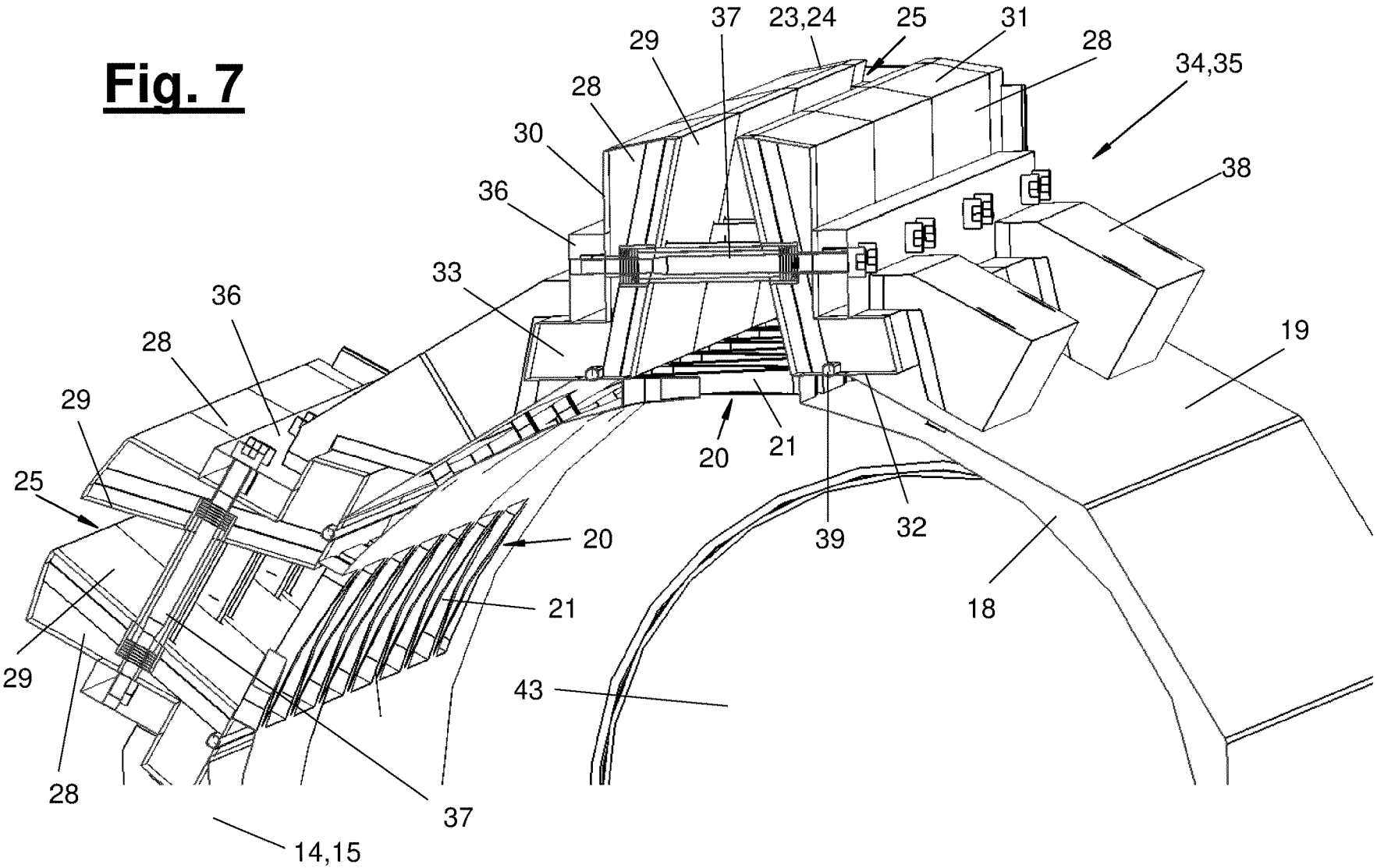
FIG. 7 is a broken-away and enlarged as well as sectional detail view of the jet suction pipe with two suction nozzles configured as nozzle attachments.
Figure 8:
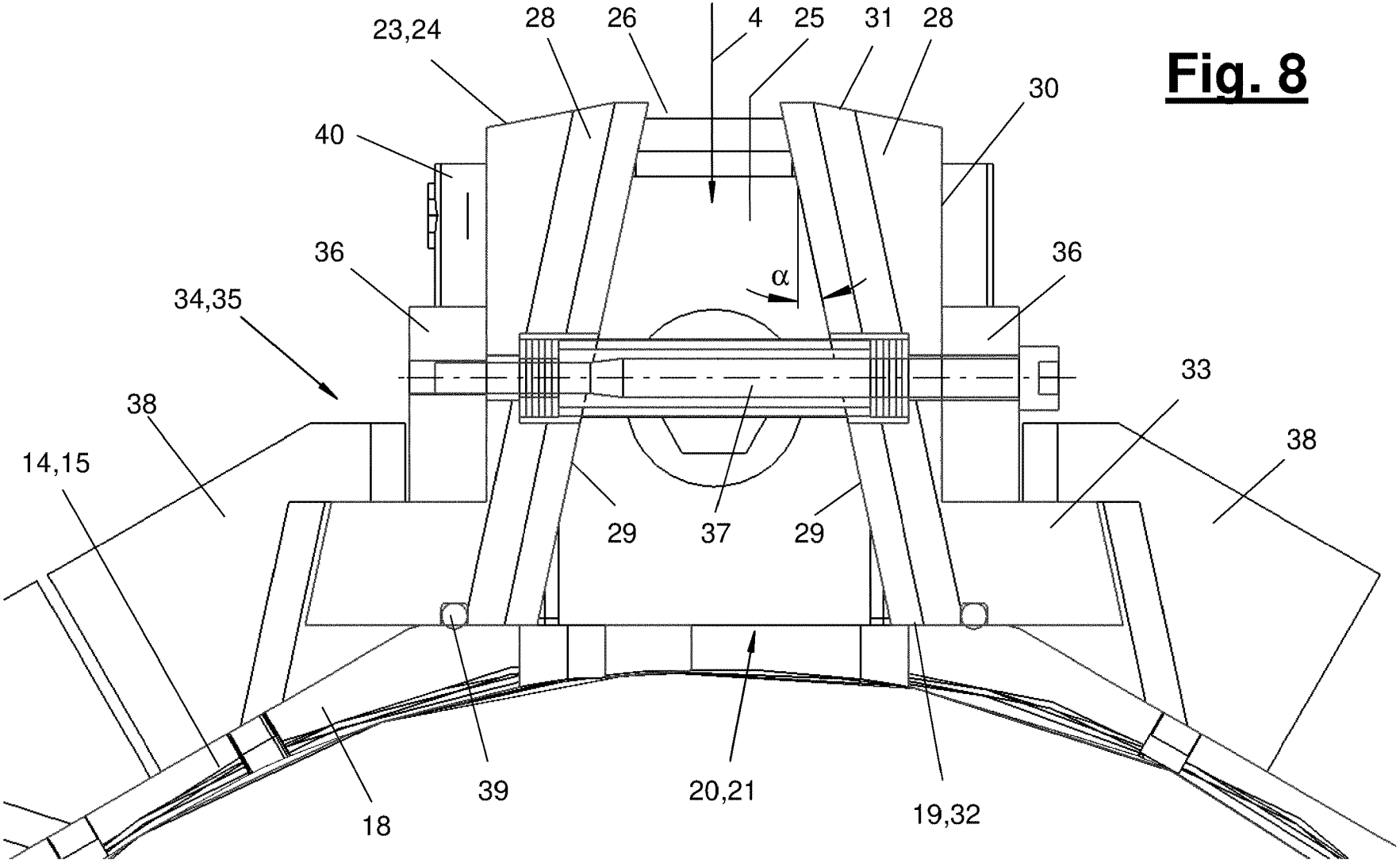
FIG. 8 is a broken-away and enlarged front view of a nozzle attachment in a sectional view.

FIGS. 3 through 8 illustrate the embodiment of the jet suction box (14) and of the jet suction pipe (15). The hollow jet suction pipe (15) has a box casing (18) or tube casing, which on the inner side has a cylindrical configuration in the cross section and on the outside has a prismatic shape with a plurality of flat sections (19). FIGS. 7 and 8 illustrate this embodiment.

The jet suction pipe (14) has on its box casing (18) at least one suction nozzle (23) with a slot shape suction opening (25). The width of the suction opening (25) increases towards the box interior (17). The suction opening (25) may in this case have a conical cross section, as is shown, e.g., in FIGS. 6 through 8. A stepped cross-sectional expansion is likewise possible. The suction nozzle (23) and its slot shape suction opening (25) extend along the axis (16) or suction box axis. Furthermore, they preferably extend over the entire breadth of the fibrous material web (2).

The number and arrangement of the suction nozzles (23) may be dependent on the number and arrangement of the one or more injectors (3). In the exemplary embodiment being shown, e.g., three injectors are arranged in the arc around the conveying drum (12) and the jet suction pipe (15). The arc arrangement and the emission direction of the liquid jets (4) may be concentric to the axis (16).

The suction nozzles (23) are arranged in a corresponding distribution on the box casing (18) of the jet suction pipe (15). They point with their suction opening (25) towards the respective associated injector (3) and are located opposite this injector in the direction of emission. The liquid jet (4) emitted by the respective injector (3) directly reaches the suction opening (25) after passing through the fibrous material web (2) and the conveying device (11, 12). This situation is shown with arrows in FIG. 6.

The emission direction and the vertical axis of the suction opening (25) are aligned radially to the axis (16). The penetration of the respective liquid jets (4) into the suction opening (25) is supported by the vacuum in the box interior (17) and by the suction action. Moreover, air is suctioned in from outside through the suction opening (25) and carried along with the liquid jets (4).

In the exemplary embodiments being shown, the three suction nozzles (23) arranged distributed on the box casing (18) in the circumferential direction are each configured as a nozzle attachment (24), which is arranged over an axial casing opening (20) in the box casing (18). Each nozzle attachment (24) protrudes outwards from the box casing (18) in the radial direction and reaches up to close to the conveying device (11), especially close to the conveying drum (12, according to FIGS. 1 and 6. The close approach or possibly also contact of the nozzle attachment (24) with the conveying device (11), especially with the conveying drum (12), prevents a lateral suctioning of infiltrated air, especially from the intermediate space (22).

The preferably slot shape casing opening (20) extends along the axis (16) in the box casing (18). It extends over the material web breadth and ends in front of the end-face edges of the jet suction pipe (15). A plurality of support struts (21) are each arranged in the slot shape casing openings (20). The arrangement may have an oblique alignment and may have a lattice-work shape configuration.

The nozzle attachments (24) have axially directed side walls (28), which are spaced apart from each other laterally and the suction opening (25) is arranged between them. The suction opening (25) opens on the inlet side (26) or on the outer side of the nozzle attachment (24) and close to the conveying device (11, 12). The suction opening (25) opens at the casing opening (20) at the outlet-side end (27).

The nozzle attachment or nozzle attachments (24) are each tightly closed at the end faces by means of closures (40). An axial support of the side walls (28) may also take place here. The side walls (28) may be one-piece or multi-part. In the exemplary embodiments shown, they are segmented, and the respective side wall segments are guided in a positive-locking manner to one another by means of complementarily graduated end faces.

The suction opening (25) preferably has the conical cross-sectional shape shown. The width of the suction opening (25) is smaller on the inlet side (26) than on the outlet side (27). The width of the casing opening (20) in the box casing (18) may be equal to or greater than the outlet-side width of the suction opening (25).

The side walls (28) of the nozzle attachments (24) may each have an oblique inner wall (29) for the formation of said change in width. The wall obliqueness may be mirror-symmetrical with respect to the radial direction starting from the axis (16). As an alternative, an unsymmetrical configuration is possible. The increasing of the suction opening width may be constant in the embodiments shown.

The slope angle between the oblique wall (29) and the radial direction may be, e.g., between 8° and 15°. A range between 10° and 13° is preferred. FIG. 8 illustrates this situation.

The suction opening (25) may be adjustable in its width. As an alternative or in addition, the slope angle can also be changed or adjusted, as needed, in one embodiment, not shown.

For the width adjustment of the suction opening (25), the suction nozzle (23), especially the nozzle attachment (24), has side walls (28) movable in relation to one another and an adjusting device for the mutual adjustment thereof. The adjusting device (34) may have a clamping unit (35) for the mutual adjustment of the side walls (28) and a respective nozzle holder (38) for fixing the side walls (28) at the box casing (18).

As FIGS. 7 and 8 illustrate, the side walls (28) have each a graduated outer wall (30). This outer wall may have a laterally projecting base (33) at the lower end, which faces the axis (16). Further, the side walls (28) may have on the inlet side (26) or on the outer side of the nozzle attachment (24) a respective convexly arched or beveled top wall (31). As a result, sealing against the intermediate space (22) can be brought about together with the conveying device (11, 12).

On the outlet side (27), the side walls (28) may each have a flat bottom wall (32). The bottom wall (32) may lie on a beveled section (19) of the box casing (18) and slides along at right angles to said radial direction during the adjustment. A seal (39) each may be arranged between the bottom wall (32) and the beveled section (19).

The nozzle holder (38) holds the nozzle attachment (24) and its side walls (28) the box casing (18) and at the same time makes possible an oblique adjustment of the side walls (28) for changing the suction opening width. The nozzle holders (38) are each configured, e.g., as clamping claws, which are fastened to the box casing (18) by screws or in a different manner and which extend over the respective base (33) with a claw arm and fix same against the box casing (18) or the flat section (19). The nozzle holders (38) may extend over the entire length or a part of the length of the nozzle attachments (24). In the exemplary embodiments shown, a plurality of nozzle holders (38), which are shorter and are arranged distributed along the box casing (18), are present.

The clamping unit (35) for the adjustment of the width of the suction opening (25) acts between the opposing side walls (28) of the respective nozzle attachments (24). The clamping unit has, e.g., axial clamping bars (36), which adjoin each the outer wall (30) and are supported on the base (33). The clamping bar (36) arranged at the respective side walls (28) may have a one-piece configuration and may extend over the entire length of the respective nozzle attachment (24). As an alternative, it may be segmented.

The clamping unit (35) has, furthermore, a plurality of spring-type straight pins (37), which extend obliquely through the side walls (28) and which are fastened in an adjustable manner to the clamping bars (36). The suction opening width may be changed by adjusting, especially rotating, the spring-type straight pins (37).

The spring-type straight pins (37) may be configured, e.g., as screw pins, with which the spaced-apart clamping bars (36) can be screwed and braced against one another. The spring-type straight pins (37) traverse the side walls (28), wherein according to FIG. 8 a clamping sleeve, which is received in a respective blind hole of the inner walls (29) and is supported axially with a spring, is mounted on the respective spring-type straight pin (37) in the area of the suction opening (25). During the screwing of the spring-type straight pins (37), the clamping bars (36), including their respective side wall (28), are brought close to one another or spaced apart from each other, wherein the clamping sleeve with the springs exerts a central counterforce on the side walls (28) and holds same in contact with their respective clamping bar (36). As an alternative, the adjusting device (34) and the clamping unit (35) may be configured structurally in a different manner.

The fibrous material web (2) strengthened with the liquid jets (4) in one or more hydroentanglement devices (1) may be transported to a subsequent, further processing, not shown. This may be, e.g., a drying unit with a crushing unit and/or with a drying oven. Additional processing devices, e.g., a nonwoven-layering apparatus, a winding device, a cutting unit or the like may be connected hereto.

A variety of modifications of the embodiments shown and described and of the variants mentioned are possible. In particular, the mentioned features may be combined with one another as desired and may also possibly be transposed.

While specific embodiments of the invention have been shown and described in detail to illustrate the application of the principles of the invention, it will be understood that the invention may be embodied otherwise without departing from such principles.

LIST OF REFERENCE NUMBERS

1. Hydroentanglement device
2 Fibrous material web
3 Injector, nozzle bar
4 Liquid jet, water jet
5 Transport device
6 Suction device
7 Vacuum generator
8 Recovery unit
9 Return, water
10 Outlet, air
11 Conveying device
12 Conveying drum
13 Drive
14 Jet suction box
15 Jet section pipe
16 Axis, box axis
17 Box interior
18 Box casing
19 Flat section
20 Casing opening
21 Strut
22 Intermediate space
23 Suction nozzle
24 Nozzle attachment
25 Suction opening
26 Inlet side
27 Outlet side
28 Side wall
29 Inner wall, oblique
30 Outer wall, graduated
31 Top wall, arched
32 Bottom wall, flat
33 Base
34 Adjusting device
35 Clamping unit
36 Clamping bar
37 Spring-type straight pin
38 Nozzle holder, claw
39 Seal
40 Closure
41 Support surface
42 Flange
43 Suction opening

The invention claimed is:

1. A jet suction box for a suction device of a fibrous material web, wherein the jet suction box is intended and configured for suctioning liquid from the fibrous material web, and wherein the jet suction box comprises:

a hollow jet suction box having a box casing;

at least one slot shape casing opening, which leads to a box interior;

at least one suction nozzle with a slot shape suction opening, the suction opening having a suction opening width which increases continually towards the box interior and towards the casing opening, wherein the suction nozzle is configured as a nozzle attachment and arranged over the casing opening, wherein a casing opening width of the casing opening is equal to or greater than an outlet-side width of the suction opening.

2. A jet suction box in accordance with claim 1, wherein the suction opening has a conical cross section.

3. A jet suction box in accordance with claim 1, wherein the suction nozzle and the slot shape suction opening are aligned along a suction box axis and the jet suction box has on the box casing a plurality of suction nozzles arranged distributed in a circumferential direction.

4. A jet suction box in accordance with claim 1, wherein the jet suction box is configured as a linear jet section pipe having an outer-side prismatic casing with a flat section in an area of the casing opening.

5. A jet suction box in accordance with claim 1, wherein the nozzle attachment protrudes from the box casing.

6. A jet suction box in accordance with claim 1, wherein the nozzle attachment extends up to close to a liquid-permeable conveying device for the fibrous material web.

7. A jet suction box in accordance with claim 1, wherein a plurality of support struts are arranged in a lattice shape in the slot shape casing opening.

8. A jet suction box in accordance with claim 1, wherein the suction opening is adjustable in width and the suction nozzle has side walls, which are movable in relation to one another, and an adjusting device for the mutual adjustment thereof.

9. A jet suction box in accordance with claim 8, wherein the side walls of the suction nozzle have each a convexly arched or beveled top wall on an inlet side.

10. A jet suction box in accordance with claim 8, wherein the side walls of the suction nozzle have each a flat bottom wall on the outlet side.

11. A jet suction box in accordance with claim 1, wherein the jet suction box has an axial suction opening and is connected to a vacuum generator.

12. A jet suction box in accordance with claim 1, wherein the jet suction box is arranged relatively stationarily within a rotating, perforated conveying drum for a fibrous material web and the jet suction box has a support surface for the conveying drum.

13. A suction device for a fibrous material web, the suction device comprising:

a hollow jet suction box having a box casing;

at least one slot shape casing opening, which leads to a box interior; and at least one suction nozzle with a slot shape suction opening, the suction opening having a suction opening width which increases continually towards the box interior and towards the casing opening, wherein the suction nozzle is configured as a nozzle attachment and is arranged over the casing opening, wherein a casing opening width of the casing opening is equal to or greater than an outlet-side width of the suction opening.

14. A suction device in accordance with claim 13, wherein the suction device has a vacuum generator that is connected to the j et suction box in a flow conducting manner.

15. A suction device in accordance with claim 13, wherein the suction device has a liquid-permeable conveying device for the fibrous material web, wherein the nozzle attachment extends up adjacent to the conveying device.

16. A suction device in accordance with claim 13, wherein the suction device is arranged at an injector emitting liquid jets under pressure and the jet suction box is arranged in an emission direction of the liquid jets within a rotatingly driven and liquid permeable conveying drum.

17. A hydroentanglement device of a fibrous material web of a nonwoven fabric, the hydroentanglement device comprising:

at least one injector which emits liquid jets under pressure; and a suction device comprising:

a jet suction box, the jet suction box having a box casing;

at least one slot shape casing opening, which leads to a box interior; and at least one suction nozzle with a slot shape suction opening, the suction opening having a suction opening width which increases continually towards the box interior and towards the casing opening, wherein the suction nozzle is configured as a nozzle attachment and is arranged over the casing opening, wherein a casing opening width of the casing opening is equal to or greater than an outlet-side width of the suction opening.

18. A hydroentanglement device in accordance with claim 17, wherein the at least one injector directs the emitted liquid jets into a suction nozzle of the jet suction box, which suction nozzle is located opposite in the direction of emission and the jet suction box is arranged in an emission direction of the liquid jets within a rotatingly driven and liquid-permeable conveying drum.

19. A hydroentanglement device in accordance with claim 17, further comprising at least another injector, such that the hydroentanglement device has a plurality of inj ectors, which are arranged next to one another in a direction of movement of the fibrous material web, and opposite which is located a respective suction nozzle of the jet suction box in the emission direction.

20. A hydroentanglement device in accordance with claim 17, wherein the hydroentanglement device has a transport device for transport of the fibrous material web.

* * * * *